United States Patent [19]

Fenzl

[11] 4,282,820

[45] Aug. 11, 1981

[54] WORKPIECE-CLAMPING ASSEMBLY AT SEWING STATION

[75] Inventor: Horst Fenzl, Oerlinghausen, Fed. Rep. of Germany

[73] Assignee: Dürkoppwerke GmbH, Bielefeld, Fed. Rep. of Germany

[21] Appl. No.: 152,035

[22] Filed: May 21, 1980

[30] Foreign Application Priority Data

Jun. 16, 1979 [DE] Fed. Rep. of Germany ..... 2924412

[51] Int. Cl.[3] ..... D05B 21/00

[52] U.S. Cl. ..... 112/121.15

[58] Field of Search ..... 112/121.15, 121.11, 112/121.12, 121.29, 121.26, 308, 65

[56] References Cited

U.S. PATENT DOCUMENTS

| | | | |
|---|---|---|---|
| 3,068,816 | 12/1962 | McBean et al. | 112/65 |
| 3,774,558 | 11/1973 | School et al. | 112/121.12 |
| 3,828,703 | 8/1974 | Sugland | 112/121.15 |
| 3,980,030 | 9/1976 | Fischer et al. | 112/121.15 |
| 4,009,672 | 3/1977 | Rockerath et al. | 112/121.15 X |
| 4,150,489 | 4/1979 | School | 112/121.12 X |

*Primary Examiner*—H. Hampton Hunter
*Attorney, Agent, or Firm*—Karl F. Ross

[57] ABSTRACT

An assembly disposable at a sewing-machine station for assisting an operator in the positioning and fixing of a pair of workpieces relative to one another prior to stitching at the sewing station comprises a multiplicity of clamping modules each having six lower fingers projecting from a module housing for clamping a first workpiece to a base plate and six upper fingers for clamping a second workpiece over the first. The lower fingers and the upper fingers are rigid with respective levers pivotable by the plungers of respective pneumatic cylinders, these cylinders being energizable in a predetermined sequence by an operator-controlled push valve to effect a piecewise positioning of the first workpiece and then of the second workpiece. Preferably, the modules are hingedly interconnected for assuming a curvilinear arrangement matching the contour of a workpiece; a flexible guide web is linked to the modules and to spring-loaded shape-restoring rods and profiles corresponding to the contours of workpieces are separately engageable with the web for forcing the same to conform to the contour of a selected workpiece. A support plate orientable above the first workpiece upon the positioning thereof facilitates the positioning of the second workpiece. The modules are shiftably mounted on a frame for moving together with the clamped workpieces toward the sewing station.

11 Claims, 12 Drawing Figures

CONTROL
MOTOR
X
XI
6
8
10
11,21
16
17
19
19'
27
29
38
72
74
75
76
77
108
109
110
111
112
113
129
138

WORKPIECE-CLAMPING ASSEMBLY AT SEWING STATION

FIELD OF THE INVENTION

My present invention relates to an assembly for positioning a pair of workpieces with respect to one another and clamping the same together prior to feeding to a sewing machine.

BACKGROUND OF THE INVENTION

Prior to feeding to a sewing machine, a pair of workpieces to be stitched together must be aligned and temporarily fastened to one another. The particular form of a clamp or a gripper for effecting this fastening is generally determined by the shapes or contours of the workpieces and by the nature of the stitching to be performed. Insofar as the workpieces are essentially regular in form and of substantially the same length and contour, a simple and generally servo-actuated clamp, such as that described in German utility patent (deutsche Gebrauchsmusterschrift) Ser. No. 1,961,860, is sufficient.

If the workpieces are irregular in form, it is necessary to utilize a gripper or fastening assembly including a multiplicity of individual clamps. German Open Application (deutsche Auglegeschrift) Ser. No. 2,164,862 described such a workpiece gripper assembly which is provided with shiftably mounted and commonly actuatable clamps.

To the state of the art also belongs a gripper assembly, according to German utility patent Ser. No. 1,982,797, in which one workpiece is laid over another and which is provided with a special device for putting pleats or folds into the workpieces.

In known positioning and fastening assemblies of the above-described type, it is generally difficult to position a second workpiece or fabric strip on a previously positioned and clamped strip, owing to catching of the strips and consequent ruffling of the upper strip. In addition, some workpieces are inherently difficult to position prior to clamping, e.g. because of a high density and/or a high flexibility.

OBJECTS OF THE INVENTION

An object of my present invention is to provide an improved positioning and clamping assembly of the above-mentioned type, in which catching and ruffling of the upper workpiece is reduced or eliminated.

Another object of my present invention is to provide such an assembly in which the positioning and clamping of heavy and flexible fabrics is facilitated.

SUMMARY OF THE INVENTION

An assembly disposable at a sewing-machine station for positioning workpieces with respect to one another prior to stitching together at the sewing station comprises, according to my present invention, an arrest or guide on a frame for enabling the sequential alignment by an operator of a first workpiece and a second workpiece. A plurality of independently actuatable first clamps are mounted on the frame for fixing respective portions of the first workpiece with respect to the frame upon the alignment of these portions by means of the arrest. Similarly, a plurality of independently actuatable second clamps are mounted on the frame for fixing the locations of respective sections of the second workpiece with respect to the frame upon the alignment of these sections via the arrest. An operator-controllable actuator on the frame is operatively connected to the clamps for selectively actuating the same to effectuate a piecewise positioning of the first workpiece relative to the frame and of the second workpiece relative to the first. Transfer means, e.g. a guide, are provided on the frame for at least facilitating the delivery to the sewing station of the workpieces upon the clamping together thereof.

According to another feature of my present invention, a plurality of housings equal in number to the first clamps and to the second clamps are disposed end to end on the frame and have respective outer surfaces or sides facing in substantially the same direction to form the arrest. Each housing supports a first clamp and a second clamp, the second clamp being mounted above the first.

According to further features of my present invention, the housings are pivotably interconnected or articulated to one another for assuming a curvilinear arrangement to match a contour of a workpiece. A flexible guide web, preferably in the form of a metal strip, is linked to the housings and control means on the frame are connected to the web for inducing the same to conform to the workpiece contour, thereby forcing the housings to assume the matching curvilinear arrangement. The control means advantageously includes spring-loaded rods attached to the web and to the frame, a pattern plate having a profile corresponding to the workpiece contour being engageable with the web.

According to yet further features of my present invention, each clamp includes a plurality of fingers projecting from the respective housing at the associated arrest surface, the housings being mounted on one or more base plates which cofunction with the fingers in clamping the workpieces. The housings each include a first pneumatic cylinder for actuating the respective first clamp and a second pneumatic cylinder for actuating the respective second clamp, the actuator including a push valve separately connected to the pneumatic cylinders of the housings for sequentially operating the first clamps and subsequently sequentially operating the second clamps to effect a piecewise positioning of the first workpiece and then of the second workpiece. Preferably, the push valve is connected to a knee bar controllable by an operator for determining the rate at which the clamps are actuated.

Pursuant to another feature of my present invention, the clamps are shiftably mounted on the frame for moving toward the sewing-machine station together with the workpieces upon a fixation of the relative positions thereof, i.e. upon a clamping of the workpieces.

In order to facilitate the positioning of the second workpiece over the first workpiece, a support or carrier plate is pivotably mounted on the frame for assuming a disposition juxtaposed to the clamps. The support is swingable from a neutral orientation to the workpiece-positioning orientation or disposition by an operator-controllable pneumatic cylinder.

BRIEF DESCRIPTION OF THE DRAWING

These and other features of my present invention will now be described in detail, reference being made to the accompanying drawing in which.

SPECIFIC DESCRIPTION

Figure 1:
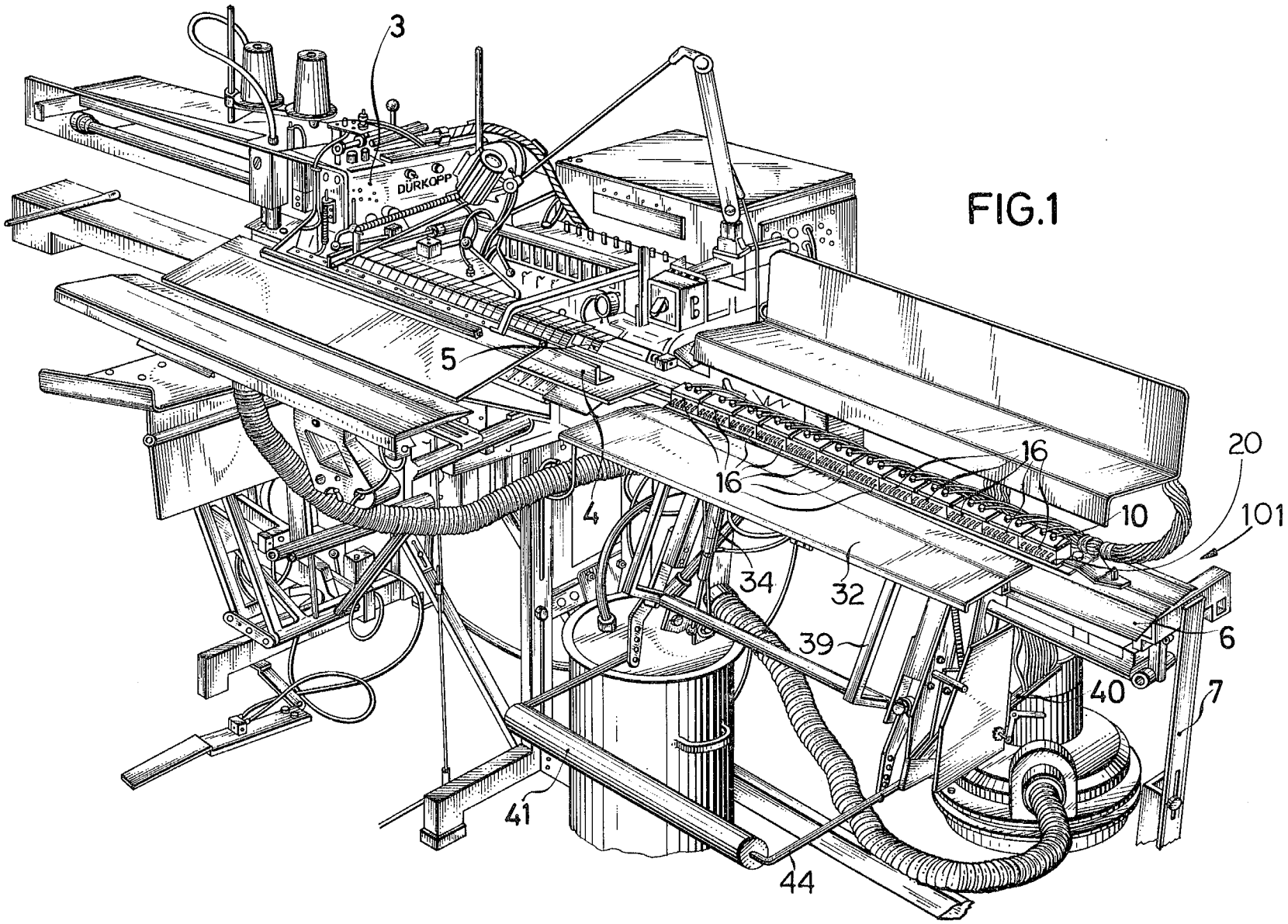
FIG. 1 is a perspective view of a sewing-machine station including a workpiece-positioning and-clamping assembly according to my present invention.
Figure 2:
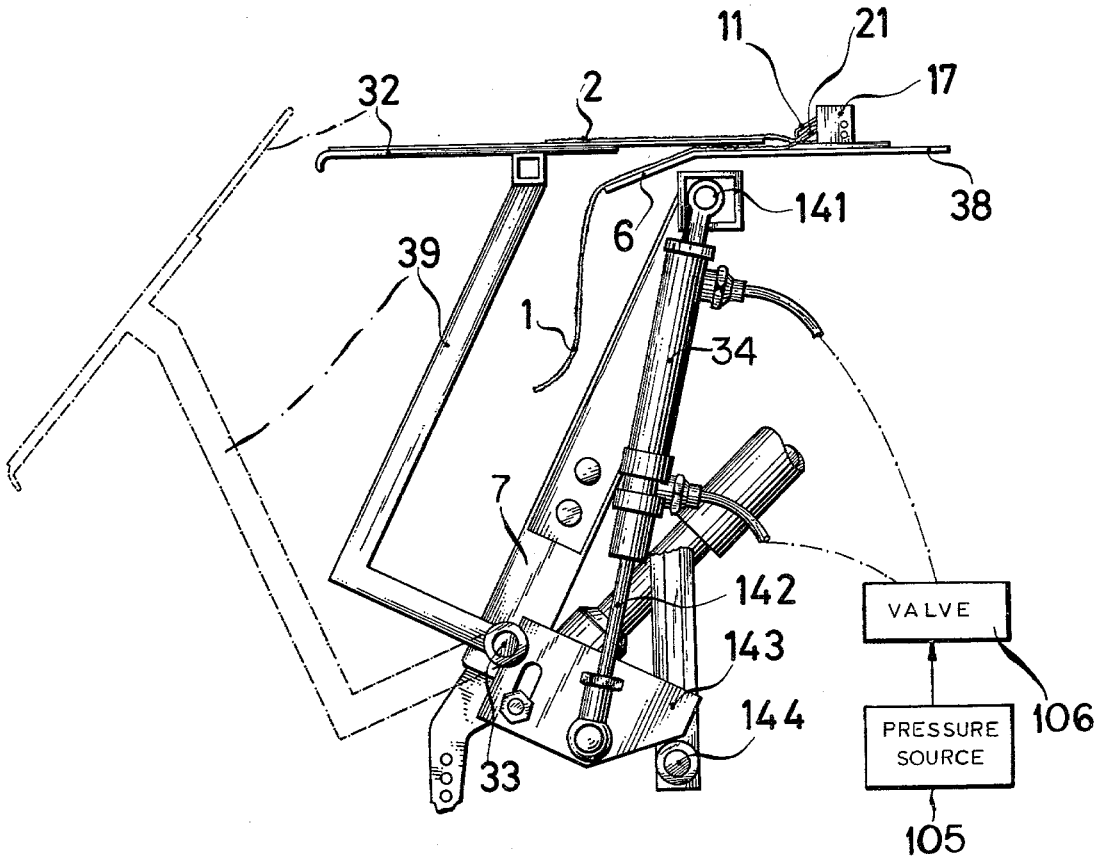
FIG. 2 is a side view of a workpiece-support plate and a pivoting mechanism therefor, included in the assembly shown in FIG. 1.

As shown in FIG. 1 an assembly for sewing together elongate workpieces 1 and 2 (see FIGS. 4 and 5) comprises a sewing machine 3 to which the workpieces are fed by means of a guide rail 4 and a needle bar 5. The guide rail is pivotably and reciprocatably mounted at the sewing station for gripping the workpieces and feeding them to the sewing machine 3.

A device 101 for positioning workpieces or strips of material 1 and 2 prior to the feeding thereof to rail 4 and bar 5 comprises, according to my present invention, a multiplicity of clamping modules 16 mounted on a frame 7 preferably shiftably for reciprocation toward sewing machine 3, i.e. generally parallel to guide rail 4 and bar 5.

Figure 3:
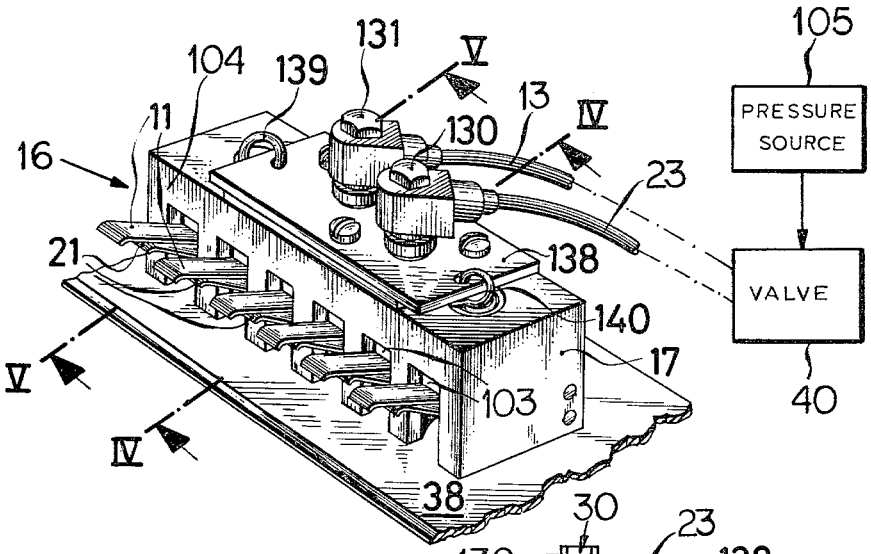
FIG. 3 is a perspective view of a clamping module included in the assembly of FIG. 1.
Figure 4:
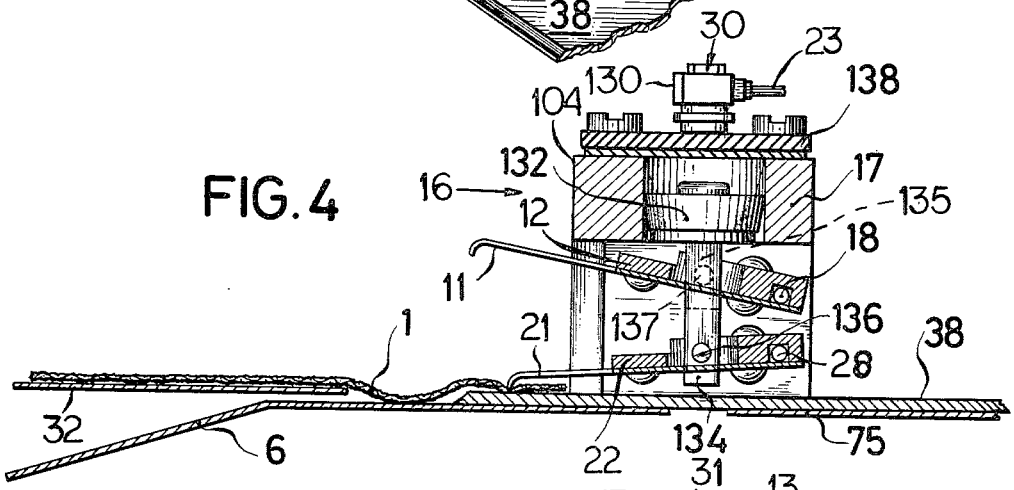
FIG. 4 is a cross-sectional view taken along line IV—IV in FIG. 3.
Figure 5:
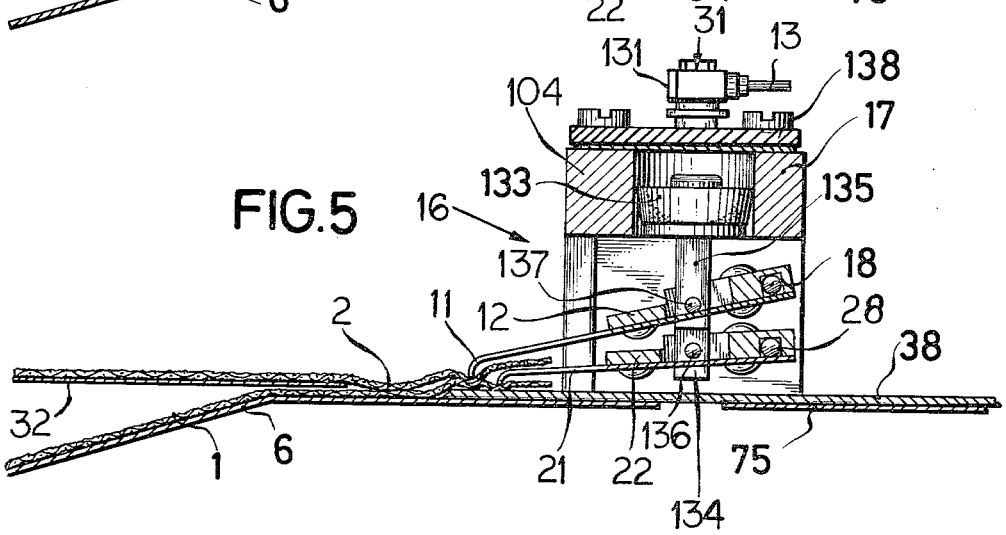
FIG. 5 is a cross-sectional view taken along line V—V in FIG. 3.

As best seen in FIGS. 3–5, each module 16 includes six upper clamping fingers 11 and six lower clamping fingers 21 which project from slots 103 formed in a face or side 104 of a housing 17 mounted on a base plate 38. Fingers 11, 21 are rigid with respective lever arms 12, 22 swingably attached to housing 17 at pivots 18, 28 and to respective plungers 135, 134 of pneumatic cylinders 31, 30 at pivots 137, 136. Plungers 134, 135 extend from pistons 132, 133 seated in respective bores of housing 17, these bores communicating with a pressurized-air source 105 via a valve 40, a pair of air hoses 23, 13 and couplings 130, 131. These couplings are fastened to a cover plate 138 screwed to housing 17. As illustrated in FIG. 3, a pair of restoring springs 139, 140 are linked to plate 138 and to levers 12, 22 for exerting thereon a lifting force tending to rotate the same in a clockwise sense about pivots 18, 28, i.e. in opposition to pressure from source 105.

Base plate 38 rests on two further plates 6 and 75 rigid with frame 7, plate 6 serving to support a greater portion of workpieces 1 and 2 upon fixation thereof by clamping modules 16. A carrier plate 32, shown in FIGS. 1, 2, 4, 5 is provided for supporting upper workpiece 3 during positioning thereof prior to clamping. Carrier 32 is rigid with an L-shaped arm 39 (FIG. 2) hingedly connected at 33 to frame 7 for swinging about an axis extending substantially parallel to rail 4, bar 5 and modules 16, arm 39 having an extension in the form of a truncated trapezoidal plate 143. This extension is pivotably secured to a plunger 142 of a pneumatic cylinder 34 in turn articulated at 144 to frame 7. Cylinder 34 is charged by pressure source 105 via a manually operated valve 106 for extending or retracting plunger 142, the extension thereof being limited by a stopper 144 adjustably secured to frame 7.

Plate 32 supports the first or lower workpiece 1 during positioning thereof against sides 104 of modules 16, these sides functioning as an arrest or aligning guide. Upon the positioning of workpiece 1 and the clamping thereof by lower fingers 21, carrier or support 32 is pivoted from a positioning-effective orientation to a withdrawn or neutral orientation shown in dot-dash lines in FIG. 2. Workpiece falls down onto plate 6 and support 32 is restored to its working orientation to facilitate the positioning of the second or upper workpiece 2 prior to clamping thereof by upper fingers 11.

Figure 6A:
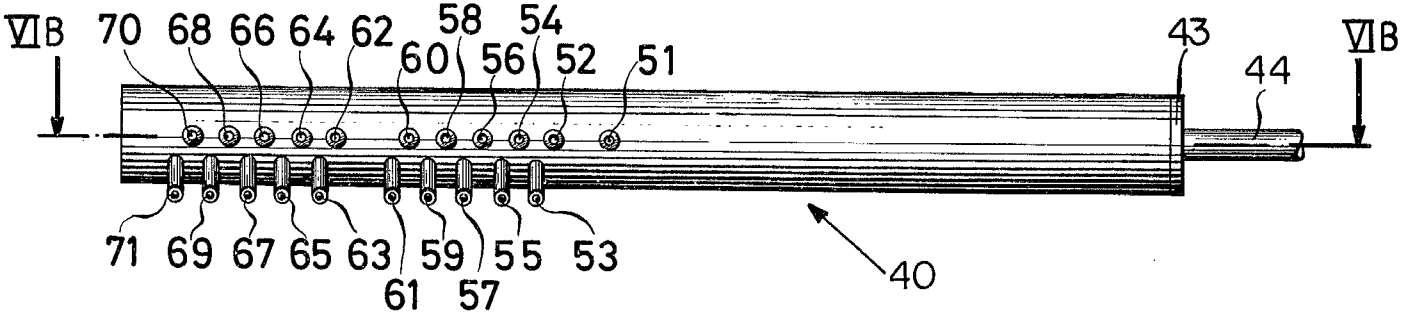
FIG. 6A is an elevational view of a push valve included in the assembly of FIG. 1 for sequentially actuating a plurality of clamping modules such as that shown in FIG. 3.
Figure 6B:
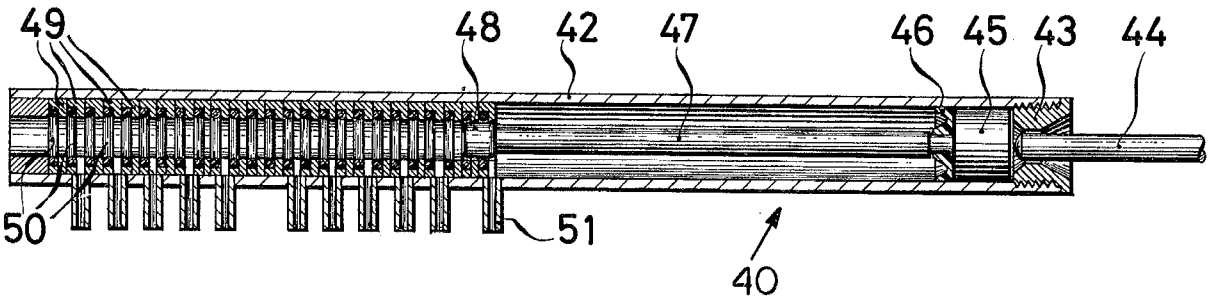
FIG. 6B is a cross-sectional view taken along line VIB—VIB in FIG. 6A.

Frequently, the fabric or material to be sewn will be of such a nature, e.g. weight, as to require piecewise clamping by fingers 11 or 21. In this case, valve 40 (FIG. 3) advantageously takes the form of a conventional longitudinal push valve illustrated in detail in FIGS. 6A and 6B. Valve 40 has a cylindrical casing 42 which is provided with an annular end cap 42 traversed by an actuating rod 44. This rod, as seen in FIG. 1, extends from a spring-loaded knee bar 41 movably mounted on frame 7. Within casing 42 rod 44 is connected to an aligning cylinder or piston 45 to which a sealing ring 46 is attached for forming an air-tight fit with an inside surface of casing 42. Twenty-five bushings or liners 49 are inserted in a press fit in casing 42 at an end thereof oppisite cap 43, each bushing having a circular groove for seating a respective O-ring 50. A radial aperture in nearly every bushing communicates with a respective pipe stub 51–71 welded to casing 42. Stub 51 is connected via a hose (not shown) to pressurized-air source 105 (FIG. 3), while stubs 52–61 are linked via hoses 23 to respective pneumatic cylinders 130 of modules 16 for actuating clamping fingers 21 and stubs 62–71 are tied to cylinders 131 for actuating fingers 11.

A push rod 47 rigid at one end with piston 45 carries at an opposite end a cylinder 48 having a height equal to twice the width of bushings 49 and a diameter equal to the inside diameter of rings 50, whereby this cylinder sealingly engages the same during a traversal of bushings 49 under the action of push rod 47. Upon an initial application of pressure to knee bar 41 by a sewing-machine operator, cylinder 48 shifts to the left in FIG. 6B, thereby inducing the pressurization by source 105 of an annular space around rod 47 in casing 42. Further pushing of actuator 44 shifts cylinder 48 further to the left and opens an air-flow path extending to cylinder 30 of a first clamping module 16, e.g. to the module disposed nearest to rail 4 and bar 5. The lower fingers 21 of adjacent modules 16 may be successively actuated under the control of the operator, thereby facilitating the piecewise positioning and the successive clamping of adjacent portions of lower fabric strip 1. Likewise, upon the withdrawal and return of support 32, upper fabric strip 2 may be piecewise positioned and clamped via operated-regulated pushing of rod 44, enabling the successive establishment of air paths extending to cylinders 31 of adjacent modules 16 from respective pipe stubs 62–71 of valve 40. In the event of mistaken setting, e.g. misaligned workpieces, pneumatic cylinders 30 or 31 or one or more adjacent modules 16 may be depressurized by temporary release of knee bar 41. Thus, an assembly 101 according to my present invention enables an aligning of fabric strips which are otherwise difficult to position; strips with pleats or folds, for example, are positioned and clamped with increased facility. An upper strip 2 may be positioned to have a fold without disturbing a pleat laid in a lower strip 1.

Figure 7:
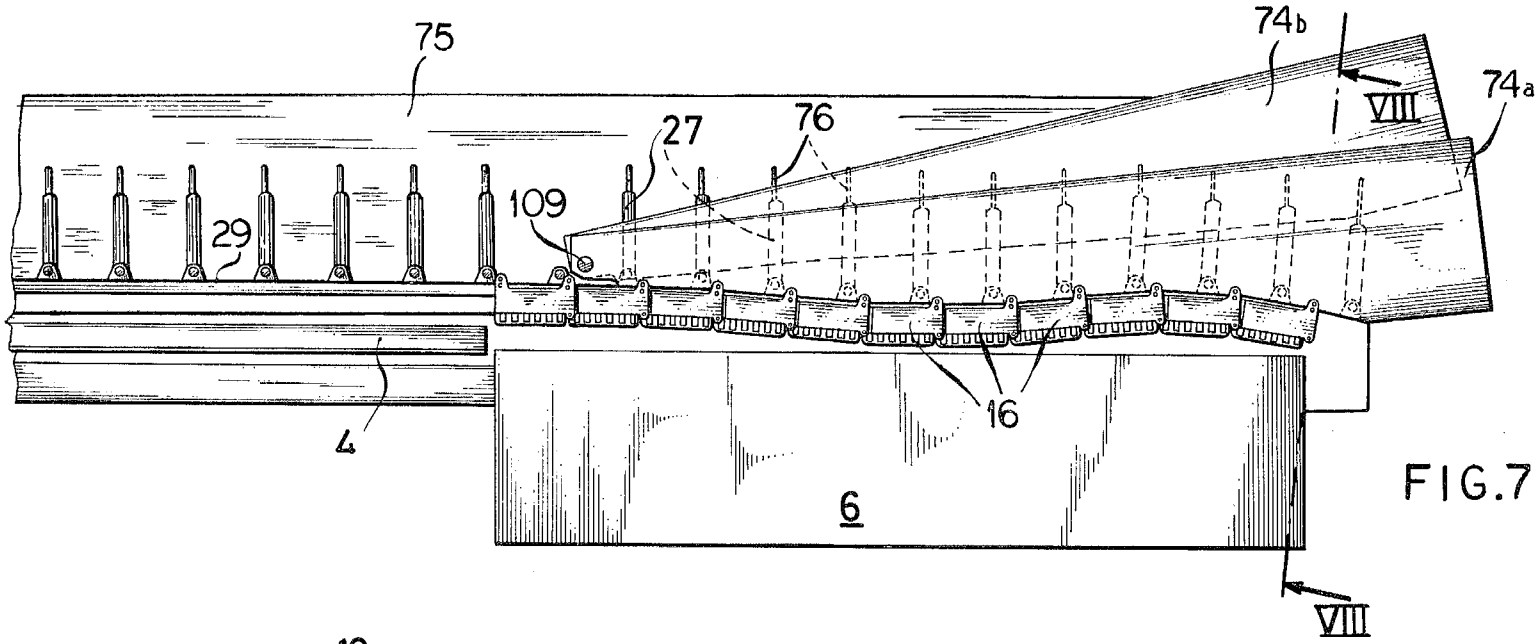
FIG. 7 is a partial plan view of a preferred embodiment of a workpiece-positioning and -clamping assembly according to my present invention.
Figure 8:
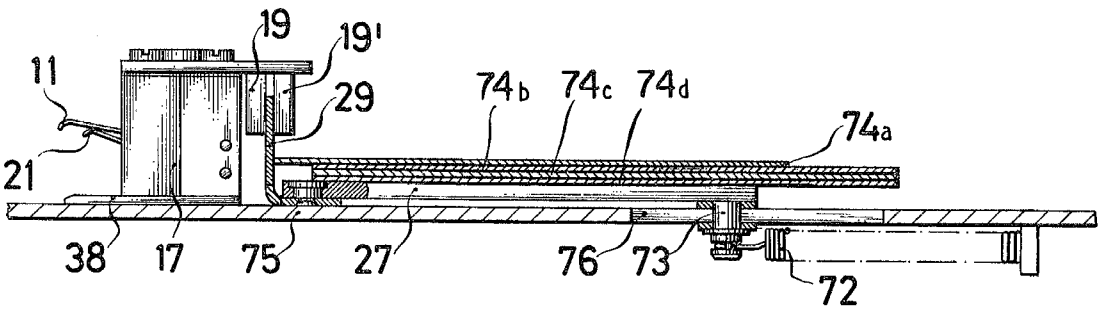
FIG. 8 is a cross-sectional view taken along line VIII—VIII in FIG. 7.
Figures 9, 10, 11:
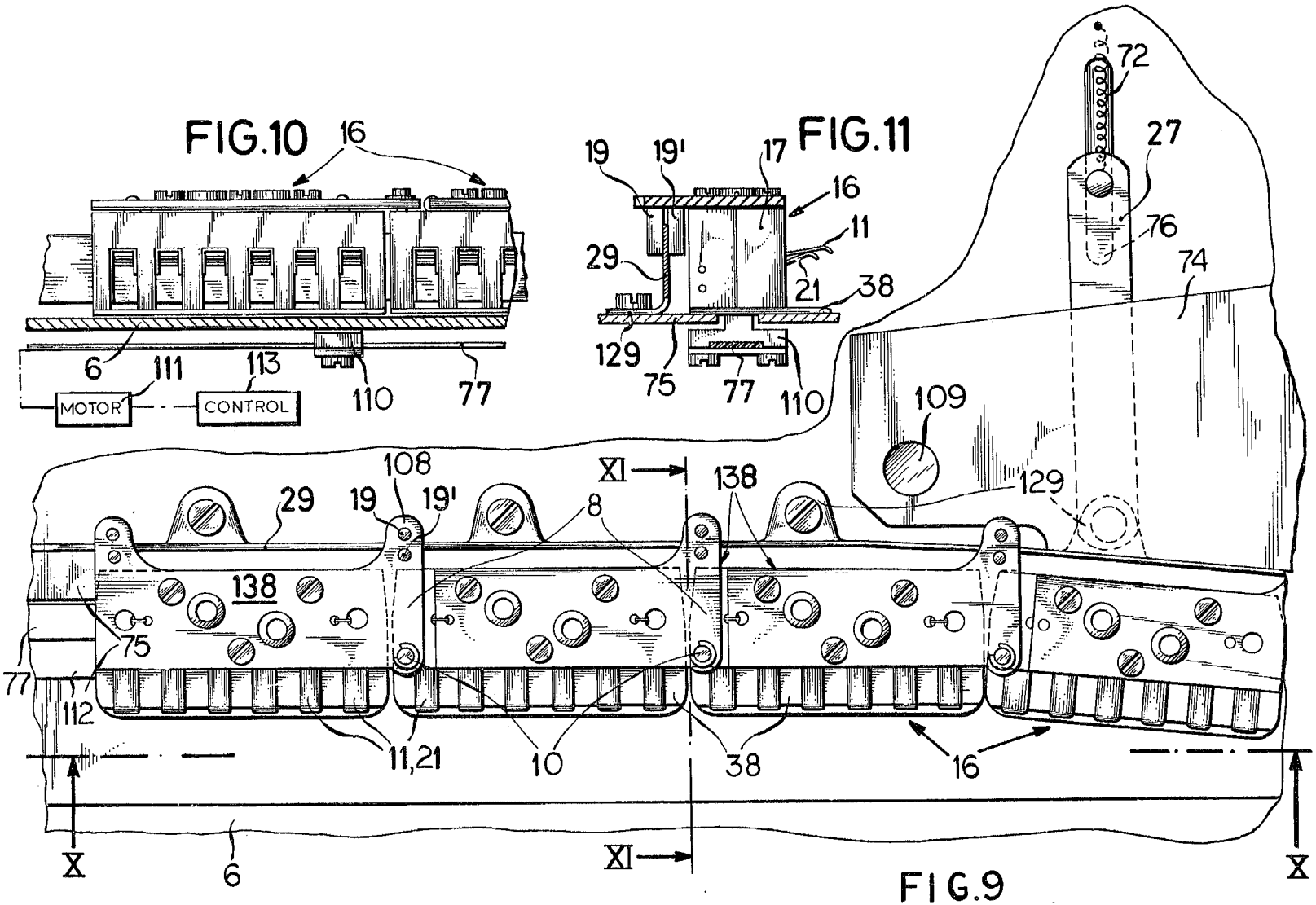
FIG. 9 is a plan view showing in detail a part of the assembly illustrated in FIG. 7.
FIG. 10 is a partial cross-sectional view taken along line X—X in FIG. 9.
FIG. 11 is a cross-sectional view taken along line XI—XI in FIG. 9.

Although it is possible to mount housings 17 all on the same base plate 38, it is preferable for each module 16 to have its own base plate 38, as shown in FIGS. 7 and 9, slidably resting on plate 75 of frame 7. Then the modules may be pivotably interconnected for assuming a curvilinear arrangement matching the contour of a workpiece. As best seen in FIG. 9, covers 138 of modules 16 are provided with extensions 8 projecting over the housings 17 of adjacent modules 16 and articulated thereto by means of sleeve-and-bolt-connections 10. Extensions 8 include respective projections 108 disposed substantially perpendicularly to an elongate dimension of modules 16, each projection 103 bearing a pair of vertical lugs 19, 19' slidably engaging a metal strip or web 29 which traverses a slot defined by the lugs. Web 29 is formed with a series of flange members 129 interspaced by a distance substantially equal to the length of modules 16. As shown in FIGS. 7–9, flange member 129 are hingedly tied to respective push-pull or position-control bars 27 which carry at ends opposite modules 16 bolts 73 extending vertically downwardly through slots 76 provided in frame plate 75, these bolts being connected to the same via tension springs 72 (FIGS. 8 and 9).

Modules 16 are entrained via articulations 10 and have a linear arrangement determined by the profile of a pattern plate 74*a*, 74*b*, 74*c* or 74*d* swingably attached at 109 to the module train. The profile surface of a selected pattern 74*a*–74*d* engages web 29 which assumes thereupon the shape of this profile surface under the action of tension springs 72 and position control bars 27, the shape of the module train matching that of the web 29. Thus, two workpieces having different contours may be successively positioned by an assembly according to my present invention, a pattern 74*a*–74*d* for the first workpiece merely being disengaged from web 29 and replaced by a pattern having a profile corresponding to the contour of the second workpiece. The facility with which this contouring operation is performed increases the rate at which aligned workpieces are fed to the sewing machine 3.

As illustrated in FIGS. 10 and 11, modules 16 are provided on their undersides with brackets 110 fastened to a belt 77 drivably connected to a reversible motor 111, brackets 110 traversing a slot 112 in frame plate 75. In response to signals from an operator-controlled unit 113, motor 11 moves belt 77 in the direction of sewing machine 3, thereby conveying modules 16, patterns 74*a*–74*d* and aligned fabric strips from a positioning station defined by catch plate 6 to a transfer station at rail guide 4 and needle bar 5 (see FIG. 7).

It is to be noted that upper clamps 11 and lower clamps 21 may function as respective clamping bars or strips 10, 20 (FIG. 1) actuatable by means of sufficiently forceful pushing of knee bar 41.

I claim:

1. An assembly disposable at a sewing-machine station for positioning workpieces with respect to one another prior to stitching together at said station, comprising:

a frame;

arresting means on said frame for enabling the sequential alignment by an operator of a first workpiece and a second workpiece;

a plurality of independently actuatable first clamps on said frame for fixing respective portions of said first workpiece with respect to said frame upon alignment of said portions via said arresting means;

a plurality of independently actuatable second clamps on said frame for fixing respective sections of said second workpiece with respect to said frame upon alignment of said sections via said arresting means;

operator-controllable actuator means on said frame operatively connected to said clamps for selectively actuating same to effect a piecewise positioning of said first workpiece and of said second workpiece; and transfer means on said frame for at least facilitating delivery to said station of said first workpiece and said second workpiece upon positioning and clamping thereof.

2. The assembly defined in claim 1, further comprising a plurality of housings equal in number to said first clamps and to said second clamps and disposed end to end on said frame, said housings having respective outer surface facing in substantially the same direction to form said arresting means, each housing holding one of said first clamps and one of said second clamps.

3. The assembly defined in claim 2 wherein said housings are pivotally interconnected for assuming a curvilinear arrangement to match a contour of a workpiece.

4. The assembly defined in claim 3, further comprising a flexible guide web linked to said housings and control means connected on said frame to said web for inducing same to conform to said contour, thereby forcing said housings to assume said arrangement.

5. The assembly defined in claim 4 wherein said control means includes spring-loaded rods attached to said web and to said frame and a pattern plate having a profile corresponding to said contour and engageable with said web.

6. The assembly defined in claim 2 or 3 wherein each of said clamps includes a plurality of fingers projecting from the respective housing at the associated outer surface, further comprising base plate means on said frame for cofunctioning with said fingers to clamp said first workpiece and said second workpiece.

7. The assembly defined in claim 6 wherein said housings each include a first pneumatic cylinder for actuating the respective first clamp and a second pneumatic cylinder for actuating the respective second clamp, said actuator means including a push valve separately connected to the pneumatic cylinders of each housing for sequentially operating said first clamps and subsequently sequentially operating said second clamps to effect a piecewise positioning of said first workpiece and then of said second workpiece.

8. The assembly defined in claim 7 wherein said valve is coupled to a knee bar controllable by an operator.

9. The assembly defined in claim 1, 2 or 3 wherein said first clamps and said second clamps are shiftably mounted on said frame for moving toward said station together with said first workpiece and said second workpiece upon fixation of the relative positions thereof.

10. The assembly defined in claim 1, 2 or 3, further comprising a support pivotally mounted on said frame for assuming a disposition juxtaposed to said first clamps and said second clamps to facilitate the positioning of said second workpiece upon the clamping of said first workpiece.

11. The assembly defined in claim 10, further comprising an operator-controllable pneumatic cylinder for swinging said support from a neutral orientation to an orientation for facilitating the positioning of said second workpiece.

* * * * *